US006772703B2

(12) United States Patent
Filges et al.

(10) Patent No.: US 6,772,703 B2
(45) Date of Patent: Aug. 10, 2004

(54) EYE-TYPE BUTTONHOLE SEWING MACHINE

(75) Inventors: Karsten Filges, Bielefeld (DE); Horst Bohl, Bielefeld (DE); Samuel Römich, Bielefeld (DE); Rainer Panhorst, Bielefeld (DE)

(73) Assignee: Dürkopp Adler Aktiengesellschaft, Bielefeld (DE)

( * ) Notice: Subject to any disclaimer, the term of this patent is extended or adjusted under 35 U.S.C. 154(b) by 0 days.

(21) Appl. No.: 10/619,355

(22) Filed: Jul. 14, 2003

(65) Prior Publication Data

US 2004/0011263 A1 Jan. 22, 2004

(30) Foreign Application Priority Data

Jul. 20, 2002 (DE) ..... 102 33 017

(51) Int. Cl.[7] ..... D05B 3/08; D05B 21/00
(52) U.S. Cl. ..... 112/66; 112/70; 112/470.18
(58) Field of Search ..... 112/66, 70, 73, 112/65, 102.5, 103, 470.06, 446, 447, 448

(56) References Cited

U.S. PATENT DOCUMENTS

| | | | | |
|---|---|---|---|---|
| 4,552,080 A | | 11/1985 | Miyazaki | |
| 5,553,565 A | * | 9/1996 | Ono et al. | 112/470.18 |
| 6,095,066 A | | 8/2000 | Nöltge et al. | |
| 6,435,115 B1 | * | 8/2002 | Yoshikazu et al. | 112/103 |
| 6,698,369 B2 | * | 3/2004 | Kwak | 112/102.5 |

FOREIGN PATENT DOCUMENTS

| | | |
|---|---|---|
| DE | 34 26 687 | 1/1985 |
| DE | G 85 07 830.1 | 7/1987 |

* cited by examiner

*Primary Examiner*—Peter Nerbun
(74) *Attorney, Agent, or Firm*—McGlew and Tuttle, P.C.

(57) ABSTRACT

An eye-type buttonhole sewing machine comprises an x-y table with an x carriage which is guided on the sewing machine and on which a y carriage is displaceably guided, having a bearing plate. Actuation of the x carriage is effected by an x motor which is mounted on the sewing machine and directly coupled with the x carriage via a cam drive. Actuation of the y carriage is equally effected via an electric motor which is directly connected to the y carriage via a threaded spindle with a spindle nut and a sliding coupling.

5 Claims, 4 Drawing Sheets

EYE-TYPE BUTTONHOLE SEWING MACHINE

BACKGROUND OF THE INVENTION

1. Field of the Invention

The invention relates to an eye-type buttonhole sewing machine.

2. Background Art

U.S. Pat. No. 6,095,066 describes an eye-type buttonhole sewing machine with a needle drivable in up and down reciprocation. It comprises an x-y table which is displaceable by stationary stepper motors mounted on the sewing machine. The x-y table is supported by way of vertical, parallel rods so that displacement in the x direction is arched. Actuation in the x direction is effected via a toothed quadrant that is coupled with a shaft with an oscillating lever mounted thereon. Actuation in the y direction takes place via an electric motor by means of a threaded spindle which runs in the y direction and the spindle nut of which is joined to the y carriage by a sliding coupling. Drawbacks reside in that accurate working of the stitch-forming tools i.e., of the needle, hook etc., is restricted or, for greater displacements, not at all attainable due to the fact that the guidance of the table is acceptable only with some reservations. Further drawbacks reside in that a considerable number of components is required, having a corresponding mass, which demands for strong dimensioning of the stepper motors.

Prior public use by Applicant has disclosed an eye-type buttonhole sewing machine in which an x-y table of the above design is drivable in the y direction by a belt drive. The oscillating levers which perform the motion in the x direction are drivable by a cam drive. The design has the additional drawback that the belt drive possesses a certain elasticity, allowing accurate positioning only to a certain extent.

SUMMARY OF THE INVENTION

It is an object of the invention to embody an eye-type buttonhole sewing machine in which motion in the x and y direction may take place very easily and accurately.

According to the invention, this object is attained in an eye-type buttonhole sewing machine, comprising a needle which is drivable in up and down reciprocation; an x-y table which supports an x carriage mounted on the sewing machine for displacement only in an x direction, and a y carriage mounted on the x carriage for displacement only in a y direction; an x motor in the form of an electric motor mounted on the sewing machine, which x motor is directly coupled with the x carriage via a drive that translates a rotary motion into a linear motion; and a y motor in the form of an electric motor mounted on the sewing machine, which y motor is directly connected to the y carriage via a threaded spindle and a spindle nut and a sliding coupling which extends in the x direction. The design according to the invention helps accomplish that the x-y table, with a work piece resting thereon, is guided precisely on an x-y level, not performing any vertical motion perpendicular thereto. With the drive which converts the rotary motion into a linear motion acting directly on the x carriage, components are saved and actuation virtually free from play is rendered possible. Likewise, the y drive is free from play because of direct conversion. Since the drives act directly on the respective x and y carriage in the x and y direction, also the mass of conversion elements is low so that strong acceleration and high positioning accuracy are attained, accompanied with driving motors of correspondingly restricted design.

Details of the invention will become apparent from the ensuing description of an exemplary embodiment, taken in conjunction with the drawing.

DESCRIPTION OF A PREFERRED EMBODIMENT

Figure 1:
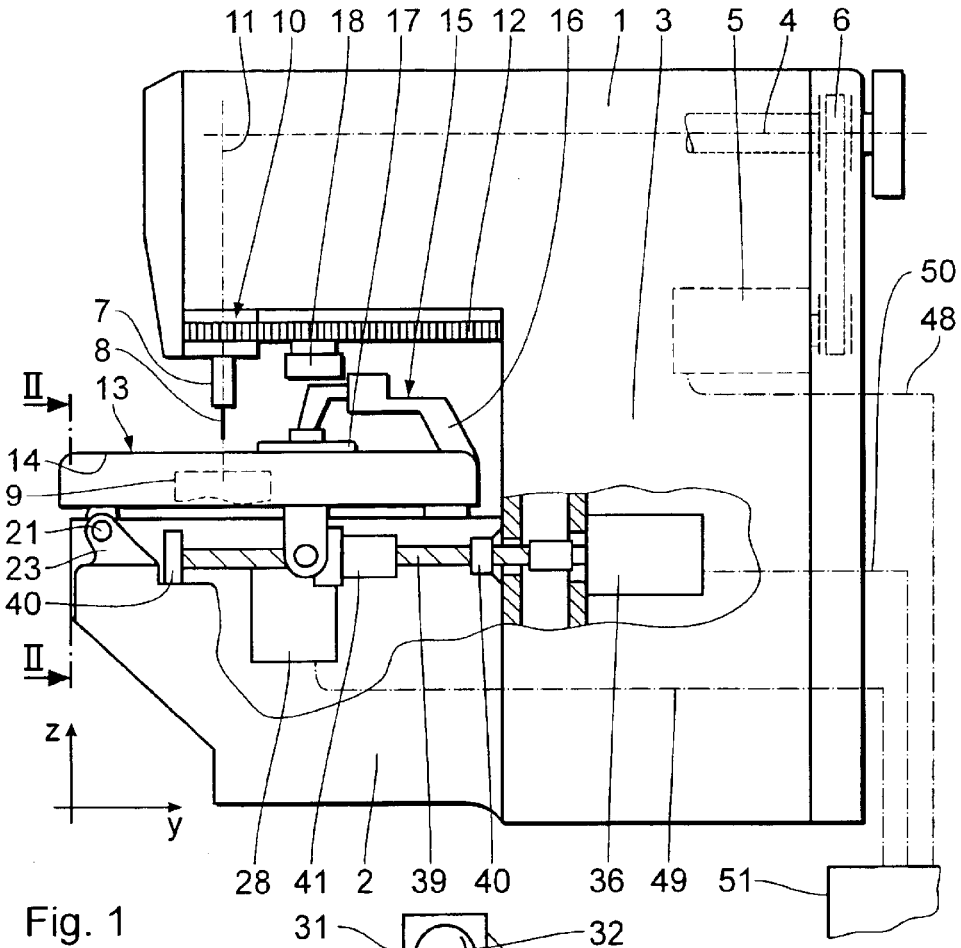
FIG. 1 is a side view of an eye-type buttonhole sewing machine.
Figure 7:
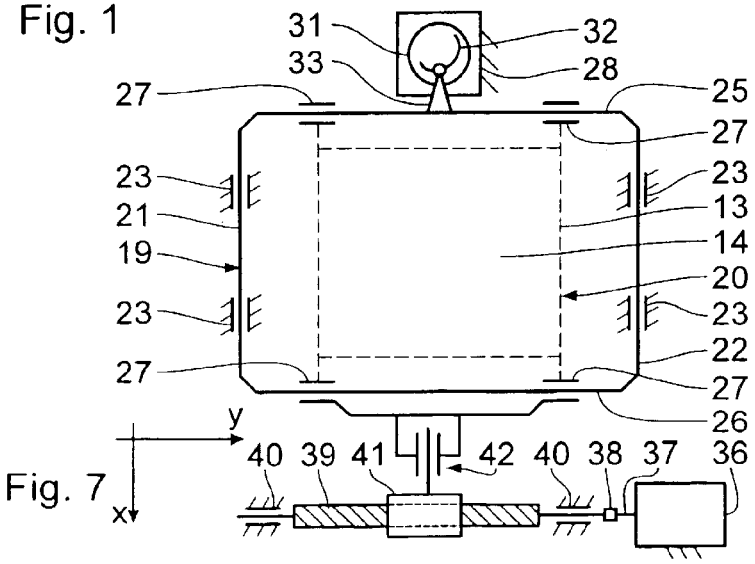
FIG. 7 is a diagrammatic view of the kinematics of the x-y table.
Figure 2:
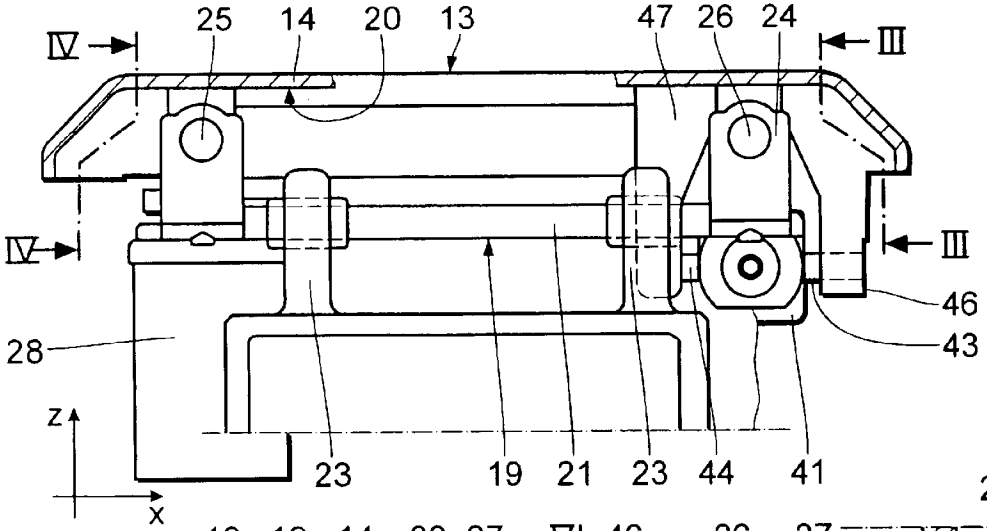
FIG. 2 is a vertical sectional view of the x-y table of the sewing machine on the line II—II of FIG. 1.
Figure 3:
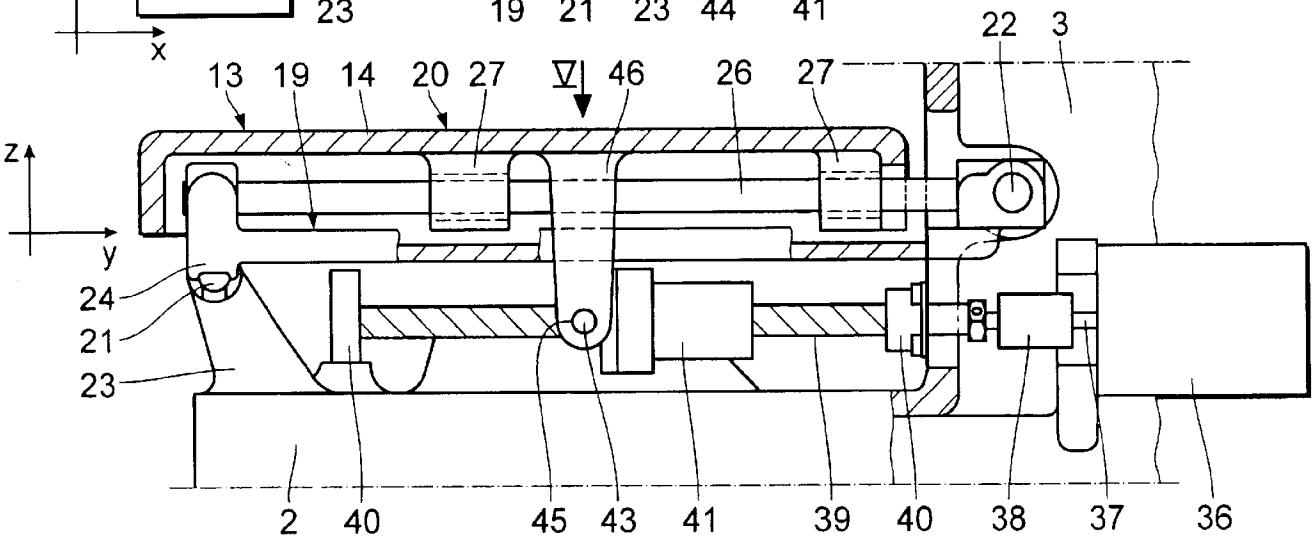
FIG. 3 is a substantially vertical sectional view of the x-y table on the line III—III of FIG. 2.
Figure 6:
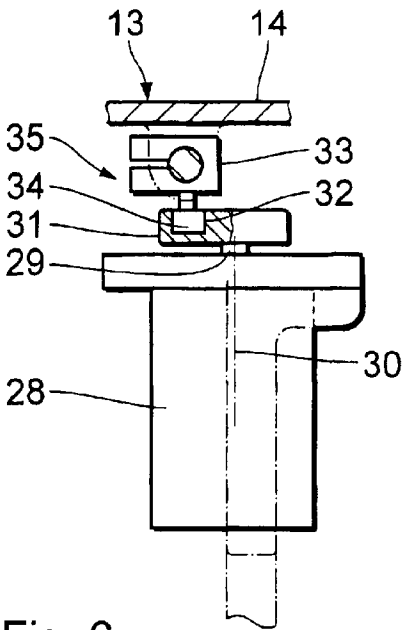
FIG. 6 is an illustration of the x drive of the x-y table on the line VI—VI of FIG. 4.
Figure 4:
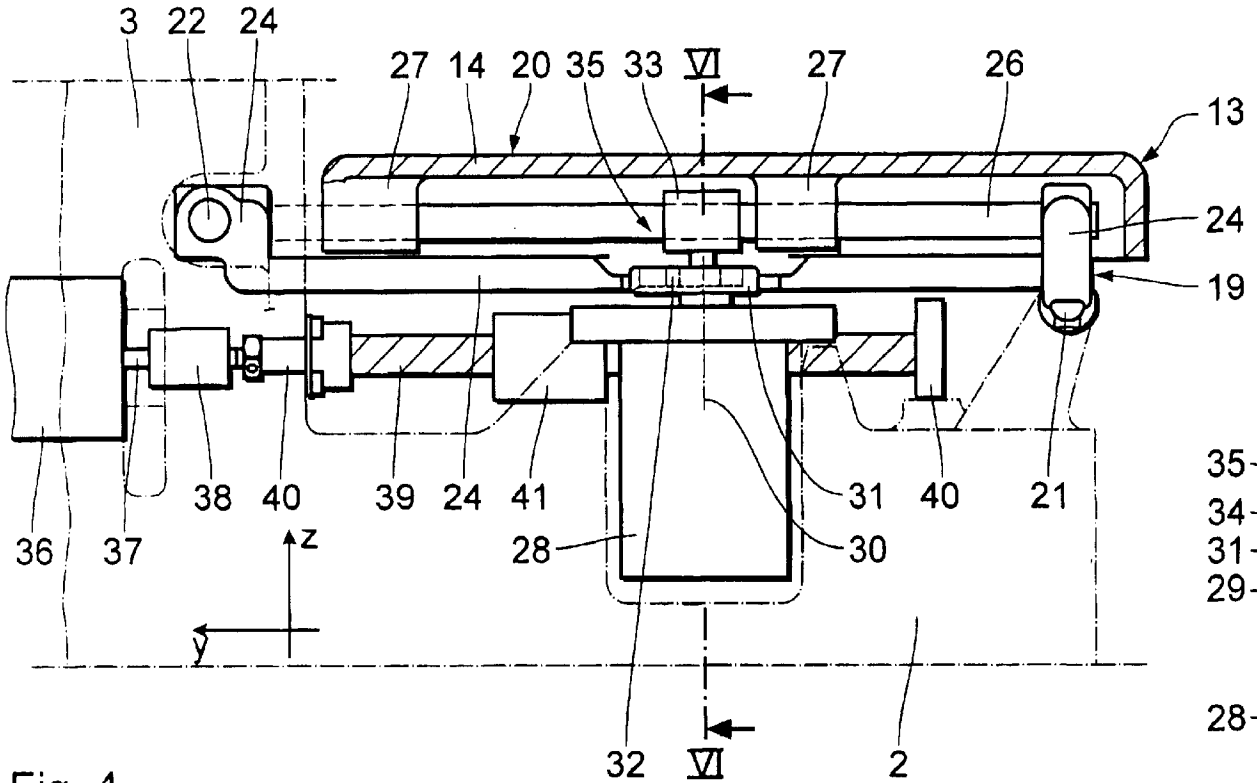
FIG. 4 is a substantially vertical sectional view of the x-y table on the line IV—IV of FIG. 2.
Figure 5:
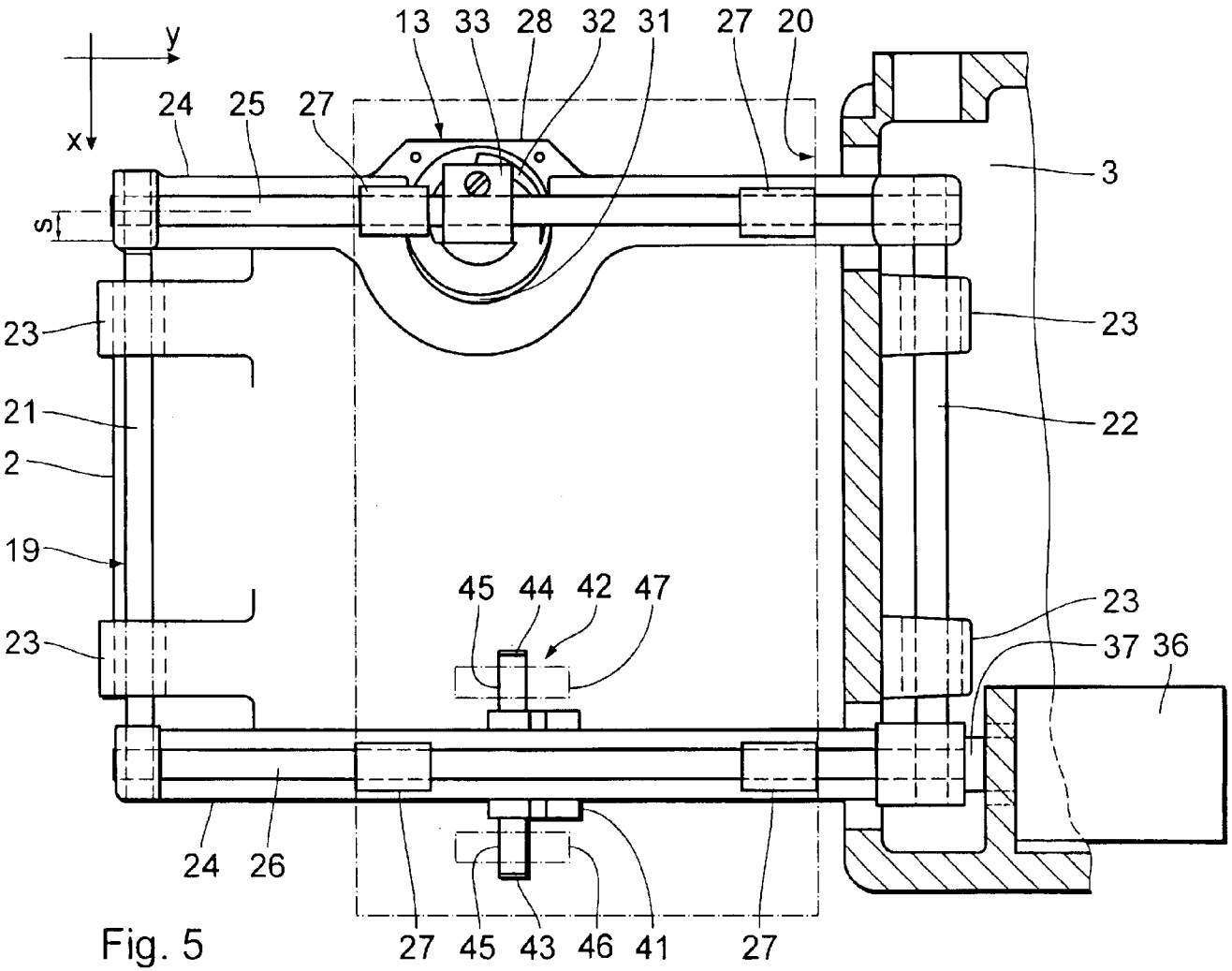
FIG. 5 is a plan view of the x-y table, with the bearing plate that rests thereon being roughly outlined by dot-dashed lines.

As seen in FIG. 1, an eye-type buttonhole sewing machine is C-shaped, which means it has a top arm 1, a bottom base plate 2 in the form of a casing, and a vertical standard 3 connecting the two. An arm shaft 4 is conventionally run in the arm 1; it is actuated by a driving motor 5 by means of a belt drive 6. Actuation of a needle bar 7, which has a needle 8 and is movable vertically in the z direction, and a jogging drive therefor are conventionally derived from the arm shaft 4. A hook bearing 9, which is disposed in the base plate 2, is allocated to the needle bar 7. The needle bar 7 is mounted on a pivot bearing 10, in which it pivots about its longitudinal axis 11 together with the hook bearing 9 for so-called eye-type buttonholes to be produced. Pivoted actuation of the pivot bearing 10 i.e., of the needle bar 7 with needle 8 and the hook bearing 9, is effected by a joint drive (not shown), of which is illustrated only a timing belt 12 that leads to the pivot bearing 10. The design of the pivot bearing 10 is known for instance from U.S. Pat. No. 6,095,066, which reference is made to.

An x-y table 13 is disposed on the base plate 2; it is a cross slide movable in two horizontal coordinate directions, namely the x direction and the y direction. It comprises a bearing plate 14 with a work piece clamp 15 disposed thereon, having a clamping plate 17 that is mounted on a pivotable bearing lever 16. Details of the structure and actuation of such a work piece clamp 15 will become apparent from U.S. patent application Ser. No. 10/410,466, which reference is made to in this regard. Located downstream of the needle bar 7 in the y direction is a buttonhole cutting device 18, which is only roughly outlined in FIG. 1. Structure and operation of such a buttonhole cutting device are described for example in U.S. Pat. No. 4,552,080. Clamped between the clamping plate 17 and the bearing plate 14 is a work piece (not shown) which is to be provided with a buttonhole that will then be cut up by means of the buttonhole cutting device 18.

Design and actuation of the x-y table 13 will be described below. It comprises an x carriage 19 which is displaceable on the base plate 2, and a y carriage 20 that is displaceable in the y direction on the x carriage 19. The x carriage 19 comprises two parallel x guide bars 21, 22 which run in the x direction and are displaceable in two x sliding bearings 23 which are stationary on the base plate 2. The two x guide bars 21, 22 are assembled in the vicinity of their free ends by means of ties 24. They are also joined to y guide bars 25, 26 which run in the x direction i.e., they are horizontal like the x guide bars 21, 22, however extending perpendicular thereto. The x guide bars 21, 22 and the y guide bars 25, 26 combine with the ties 24 to form the x carriage 19 which is rectangular in a plan view. The x guide bar 22 is disposed in the standard 3.

y sliding bearings 27 are formed on the bottom side of the bearing plate 14, with two of them at a time being disposed on each y guide bar 25, 26 so that the bearing plate 14 combines with the y sliding bearings 27, forming the y carriage 20.

Actuation of the x carriage 19 in the x direction takes place by an x motor 28 which is mounted on the base plate 2 and the driven shaft 29 of which is drivable in rotation about a vertical axis 30. A cam disk 31 is mounted on the driven shaft 29, having a cam curve in the form of a guiding groove 32 that spirals in relation to the axis 30. A driver 33 is clampingly fixed to the y guide bar 26, on its bottom side having a driving roller 34 which engages with the guiding groove 32. Owing to the arrangement of the guiding groove 32 in relation to the stationary axis 30 of the x motor 28, the x carriage 19, upon rotary or pivoted actuation of the cam disk 31 about the axis 30, is moved in the x direction, with the maximal length of displacement i.e., the maximal lift of the x carriage 19 being in the range of approximately 8 mm. Consequently, the cam disk 31 and the driver 33 form a cam drive 35, which translates the rotary motion of the x motor 28 into a linear motion of the x carriage 19.

The y carriage 20 is driven by a y motor 36 which is disposed in the standard 3 and the driven shaft 37 of which, via a coupling 38, is connected to a threaded spindle 39 which runs in the y direction. The threaded spindle 39 is rotatably housed in bearings 40 which are mounted on the base plate 2. A spindle nut 41 is mounted on the threaded spindle 39; it is connected to the y carriage 20 by means of a sliding coupling 42. To this end, aligned pins 43, 44 are mounted on the spindle nut 41; they extend in the x direction and engage with guide holes 45 of two driving arms 46, 47 which are mounted on the bottom side of the bearing plate 14. The pins 43, 44 are sufficiently long and the driving arms 46, 47 are sufficiently spaced from the spindle nut 41 for the pins 43 and 44 to be shifted in the respective driving arm 46 and 47 by the maximal length of displacement s of the x carriage 19 in the x direction upon corresponding displacements by way of the cam drive 35. Displacement of the y carriage 20 in the y direction takes place by rotary actuation of the y motor 36 via the threaded spindle 39 and the spindle nut 41 and the sliding coupling 42. The usual length of displacement in the y direction is for example 30 mm.

The x motor 28 and the y motor 36 are electric motors, preferably stepper motors or motors with rotary position feedback. In the same way as the driving motor 5, they are connected via corresponding control lines 48, 49, 50 to a control unit 51 where the control data are recorded.

What is claimed is:

1. An eye-type buttonhole sewing machine, comprising a needle (8) which is drivable in up and down reciprocation;

an x-y table (13) which supports an x carriage (19) mounted on the sewing machine for displacement only in an x direction, and a y carriage (20) mounted on the x carriage (19) for displacement only in a y direction;

an x motor (28) in the form of an electric motor mounted on the sewing machine, which x motor (28) is directly coupled with the x carriage (19) via a drive that translates a rotary motion into a linear motion; and a y motor (36) in the form of an electric motor mounted on the sewing machine, which y motor (36) is directly connected to the y carriage (20) via a threaded spindle (39) and a spindle nut (41) and a sliding coupling (42) which extends in the x direction.

2. An eye-type buttonhole sewing machine according to claim 1, wherein the drive is in the form of a cam drive (35) and includes a cam (31) which is joined to a driven shaft (29) of the x motor (28), and which cam has a guiding groove (32) that spirals in relation to the axis (30) of the x motor (28), and which cam has a driver (33) which is directly joined to the x carriage (19) and engages with the guiding groove (32).

3. An eye-type buttonhole sewing machine according to claim 2, wherein the cam disk (31) is directly mounted on the x motor (28).

4. An eye-type buttonhole sewing machine according to claim 1, wherein the sliding coupling (42) comprises at least one pin (43, 44) which is mounted on the spindle nut (41) and engages with a guide hole (45) of a driving arm (46, 47) provided on the y carriage (20).

5. An eye-type buttonhole sewing machine according to claim 1, wherein the x carriage (19) is a frame, having y guide bars (25, 26) which are guided on the sewing machine and support the y carriage (20).

* * * * *